United States Patent [19]

van Alst

[11] Patent Number: 4,564,254

[45] Date of Patent: Jan. 14, 1986

[54] IDC LATCHING TERMINAL

[75] Inventor: Wilhelmus B. T. van Alst, St. Oedenrode, Netherlands

[73] Assignee: E. I. Du Pont de Nemours and Company, Wilmington, Del.

[21] Appl. No.: 501,107

[22] Filed: Jun. 6, 1983

[30] Foreign Application Priority Data

Jun. 10, 1982 [GB] United Kingdom ..... 8216938

[51] Int. Cl.[4] ..... H01R 13/39

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,820,055 | 6/1974 | Huffnagle et al. | 339/17 |
| 4,089,580 | 5/1978 | Huffnagle et al. | 339/99 R |
| 4,153,325 | 5/1979 | Asick | 339/99 R |
| 4,410,229 | 10/1983 | Stephenson | 339/97 P |
| 4,448,473 | 5/1984 | Felix et al. | 339/99 R |

FOREIGN PATENT DOCUMENTS

| | | |
|---|---|---|
| 2739210 | 3/1978 | Fed. Rep. of Germany . |
| 2206598 | 6/1974 | France . |
| 1543661 | 8/1973 | United Kingdom . |

OTHER PUBLICATIONS

Patent Abstracts of Japan, vol. 1, No. 41, Apr. 22, 1977, p. 2446E76.

*Primary Examiner*—Joseph H. McGlynn

[57] ABSTRACT

A terminal having first and second contact ends, one being an IDC, with a body portion separating the two contacts ends and a pair of latches supported by an L-shaped member extending perpendicularly from the body portion. The terminal latches act to hold two halves of a connector assembly together.

6 Claims, 18 Drawing Figures

-PLOUGH-

-ANCHOR-

IDC LATCHING TERMINAL

BACKGROUND OF THE INVENTION

The invention relates to electrical terminals of the type generally known as "insulation displacement contact" (IDC) terminals where insulation surrounding a wire or cable is split and displaced by a pair of tines on the terminal and the locally bared wire or cable is gripped between the tines to achieve electrical contact. Such terminals will hereinafter be referred to as IDC terminals. More particularly, but not exclusively, the invention relates to the IDC terminals for use in an array of terminals for connection to a "flat" cable, being a cable having a multiplicity of insulated conductors arranged alongside one another to have the appearance of a sheet.

SUMMARY OF THE INVENTION

According to the invention, there is provided an IDC terminal having a body portion, a first contact end extending from the body portion, the first contact end comprising a pair of substantially parallel tines defining a conductor gripping slot therebetween for providing an electrical connection between the terminal and a conductor in use, and a latching portion extending from the body portion independently of the terminal portion for holding together in use parts of a housing for the terminal.

The latching portion preferably has a pair of latches adapted to hold together two parts of the housing.

The latching portion preferably exerts a holding force, in use, in a direction parallel to the direction in which the tines extend. The latching portion may be planar, and lie in a plane perpendicular to a plane in which the tines lie.

The latching portion preferably comprises a pair of spaced apart, mutually facing latch surfaces extending proud of adjacent parts of the latching portion.

The latching portion may have tapered ends, and each tapered end may meet the associated latch surface at an acute angle to provide a barb.

The first contact end may be planar, and may have an external profile substantially tulip shaped.

The conductor gripping slot may taper outwardly at the open end thereof, and may widen at the base thereof.

The terminal preferably comprises a second contact end such as a solder tail, a female contact adapted for engagement by a male contact element, or an edge card connector adapted for engagement by a contact edge of a printed circuit board. Alternatively the solder tail may have a special localized deformed or swaged zone to permit an interference or compliant press-fit connection with a plated-through hole in a printed circuit board.

The terminal may be stamped and formed in one piece from sheet metal.

The invention further provides a connector assembly comprising a pair of housing parts and a plurality, preferably a multiplicity of terminals according to the invention, each housing part having engagement means engageable by the latching portion of each terminal for holding together the housing parts.

The engagement means of each housing part preferably comprises a latch engagement surface, and the latch engagement surface may be provided by a stepped recess in the housing part, or preferably, where the latching portion has barbs, a blind hole in the housing part dimensioned such that the material of the housing part defining the hole is penetrated and gripped by the associated barb.

The two housing parts may be provided with mutually engageable locating means, for example posts and flats engageable by the posts. The posts may be at corners of the housing parts, and all the posts may be on the housing part of each pair.

The two housing parts may have mutually engageable holding means such as snap engagement latches.

The connector assembly preferably comprises cable clamping means for clamping cable to the connector assembly externally of the housing parts for reducing the opportunity for external stress applied to the cable being transmitted to the terminals.

BRIEF DESCRIPTION OF THE DRAWINGS

By way of example, one embodiment of a terminal and modifications thereto according to the invention and one embodiment of a connector assembly and modifications thereto according to the invention will now be described with reference to the accompanying drawings, in which:

FIG. 9 shows a set of terminals in a connector assembly;

DETAILED DESCRIPTION OF THE PREFERRED EMBODIMENT

Figure 1A:
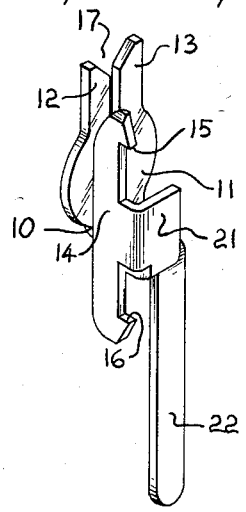
FIGS. 1A and 1B are two views of a terminal.
Figure 1B:
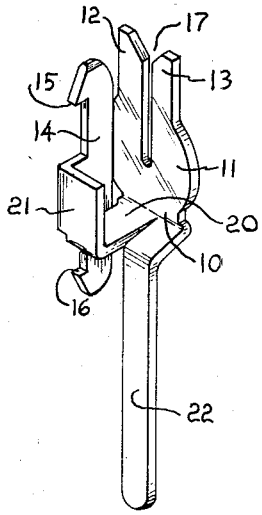

As shown in FIGS. 1A and 1B, an IDC terminal has a body portion 10 from which extend a first contact end 11 having a pair of tines 12 and 13 and also a latching portion 14, the latching portion including a pair of mutually facing latch surfaces 15 and 16.

Between the tines 12 and 13 extends a slot 17 for engagement of a conductor, the tines 12 and 13 effecting localized separation or stripping of insulation material around the conductor. The slot 17 tapers outwardly at its open end to provide entry ledges for the conductor. The outer profile of the first contact end 11 is substantially tulip shaped, as can be seen in more detail in FIG. 8. This particular shape with a broad base and narrower free ends of the tines 12 and 13 has the purpose of ensuring that the tines 12 and 13 do not short circuit with adjacent conductors of a flat cable, and also ensuring that the separation force exerted on the tines 12 and 13 when a conductor is inserted between them can be withstood by the metal of the terminal portion near the base of the slot 17, such that the tine deflection is maintained in the elastic region of the material.

From the base of the first contact end 11 extends substantially perpendicularly a shoulder 20 of the body portion 10, and from the shoulder 20 extends substantially perpendicularly a support 21 connected to the latching portion 14. The latching portion 14 lies substantially perpendicularly to the support 21, and also to the shoulder 20.

The terminal has a solder tail 22 as a second contact end extending away from the first contact end 11. Different forms of solder tail may be provided and it will also be appreciated that the solder tail 22 could be substituted by, for example, a female connector or a connector adapted to be engaged by a contact edge of a printed circuit board. Alternatively a local swaging or deformation may be introduced on the solder tail to allow interference or compliant press-fit connection with a slightly undersized plated-through hole in a printed circuit board.

Figure 2A:
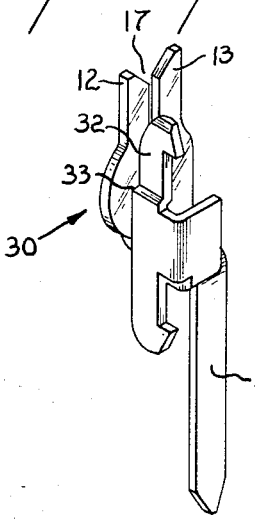
FIGS. 2A and 2B are views of the terminal of FIG. 1 with a modification thereto.
Figure 2B:
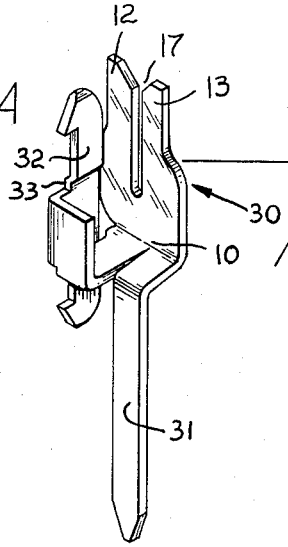
Figure 4:
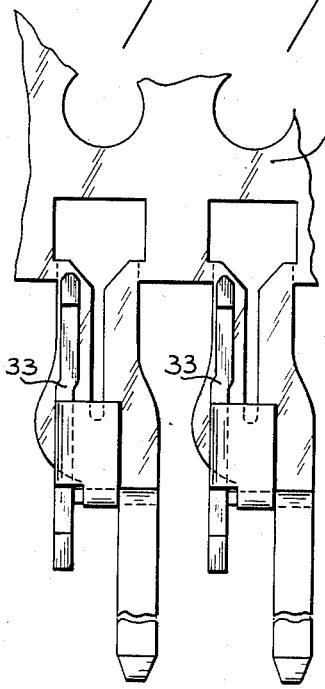
FIG. 4 shows a carrier strip carrying terminals as shown in FIG. 2.
Figure 3:
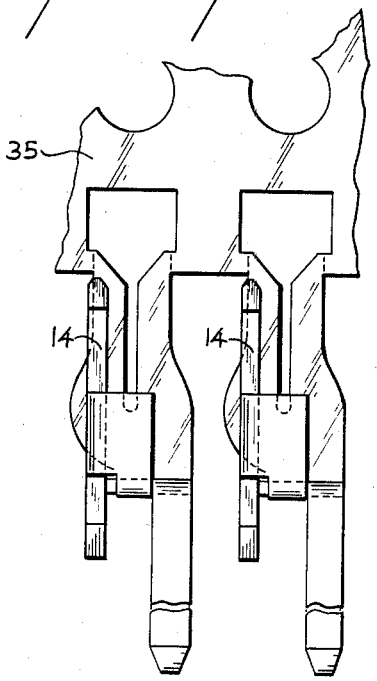
FIG. 3 is a view of a carrier strip carrying terminals according to FIG. 1.

FIGS. 2A and 2B show a modified form of the terminal of FIG. 1. The connector 30 of FIGS. 2A and 2B has a solder tail 31 and a bend in latch portion 32 at position 33. The bend 33 is provided to afford ease of access for a tool to separate terminals from a carrier strip (FIGS. 3 and 4). FIG. 3 shows a carrier strip 35 carrying terminals as shown in FIG. 1 and FIG. 4 shows a carrier strip 36 carrying terminals as shown in FIGS. 2A and 2B. With a straight latching portion 14 of the FIG. 1 terminal, there is limited space for a tool to enter and separate the terminal from the carrier strip 35. It is obvious for appropriate latching of housing parts, these latches need to be as long as possible. The FIG. 2A and 2B terminal with a latching portion 32 bent at 33 permits easier access for such a tool yet permitting a relatively long latch.

Figure 2C:
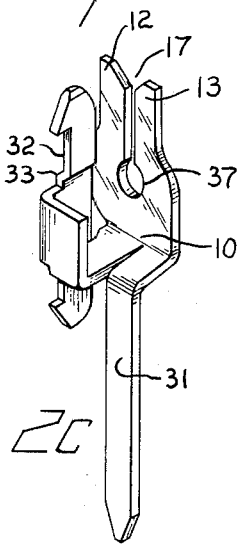
FIG. 2C is a view showing a further modified terminal.

FIG. 2C shows a terminal of FIGS. 2A and 2B further modified by enlarging the radius at the bottom 37 of the conductor slot, such that the diameter exceeds the slot gap. This slot design has arisen from calculations of stress distribution in circumstances where a particularly large wire range needs to be terminated with the same IDC terminal, or where a tougher insulation material than PVC, for example Teflon ®, is used.

The terminals shown in FIG. 2 are preferred forms of terminal but for illustration during the remainder of the specification, the FIG. 1 embodiment will be used.

Figure 5:
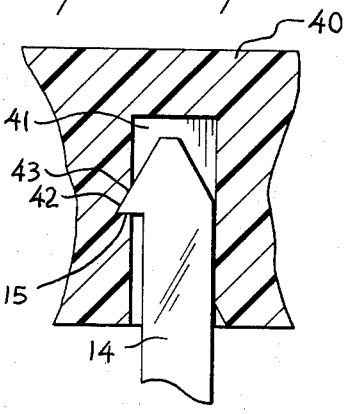
FIG. 5 shows a detail of a first latch arrangement.
Figure 6:
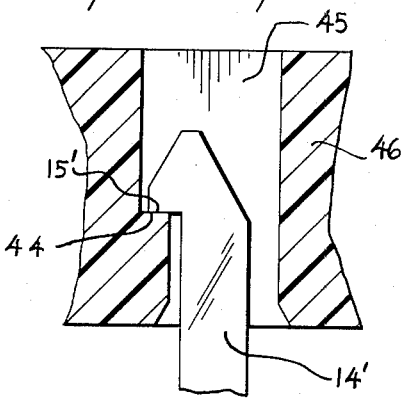
FIG. 6 shows a detail of a second latch arrangement.

The latching surfaces 15 and 16 are adapted to engage material of two corresponding housing parts forming a connector assembly. Such housing parts are commonly of plastics material, although other suitable materials could be used. FIGS. 5 and 6 illustrate two possible latching arrangements. In FIG. 5, a housing part 40 is formed with a blind hole 41 engaged by one end of the latching portion 14 of a terminal. The blind hole 41 is dimensioned such that the material of the housing part 40 is engaged by a barb 42 formed where the latch surface 15 meets a taper surface 43 of the latching portion. The barb 42 engages positively the material of the housing part 40 to lock the terminal to the housing part 40.

FIG. 6 shows an alternative latching arrangement where latching portion 14' has a latch surface 15' which engages a step 44 in a recess 45 in a housing part 46. The disadvantage of the FIG. 6 arrangement is that usually an open recess 45 is required during conventional part molding, and this allows some exposure of the terminal to the atmosphere permitting electrical contact resistance deterioration with time. The blind hole 41 of FIG. 5 is advantageous in this respect.

Figure 7A:
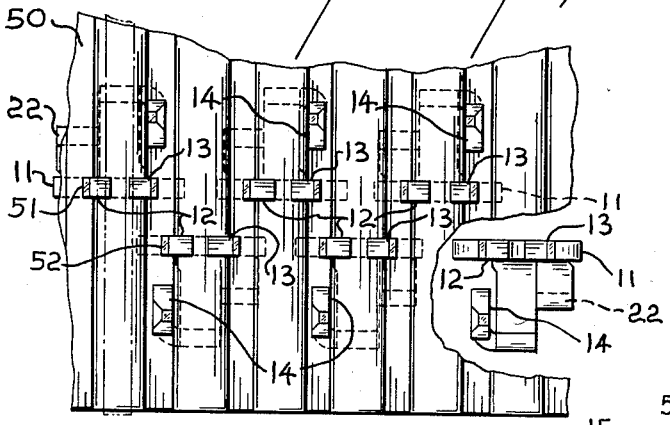
FIGS. 7A, 7B and 7C show respectively a plan, end and side views of an arrangement of terminals connected to part of a flat cable.
Figure 7C:
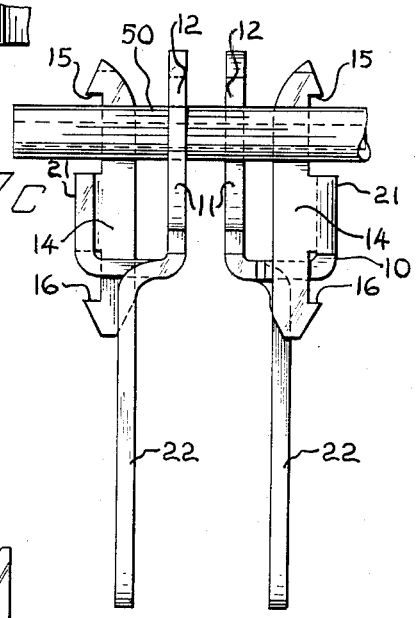
Figure 7B:
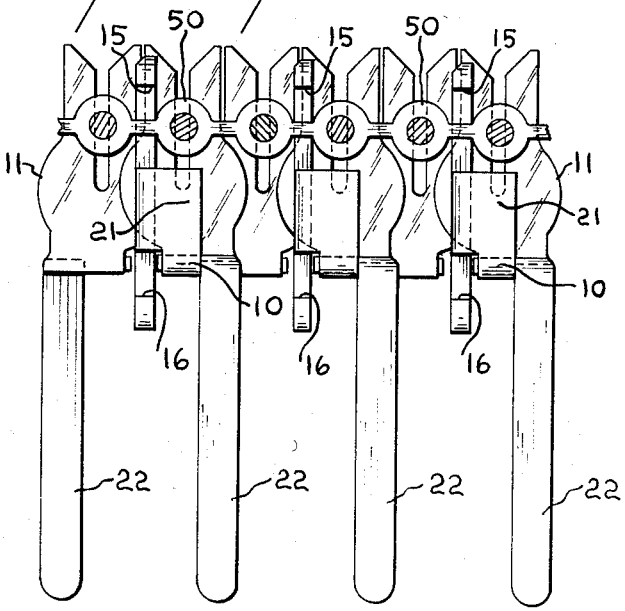

FIGS. 7A, 7B and 7C show a preferred arrangement of two rows of terminals connected to a flat cable 50. For the sake of clarity, housing parts of a connector assembly are omitted from FIG. 7. The terminals are arranged in two rows at a pitch of one tenth inch, achieving connection to the flat cable 50 whose conductors are at one twentieth inch separation. As can be seen in FIG. 7A, the terminals in rows 51 and 52 are staggered with respect to each other and the terminals in the two rows are also reversed such that the latching portion of a terminal in a particular row lies on that side of the terminal portion remote from the other row. It will be appreciated that other terminal spacings or arrangements may be used.

Figure 8:
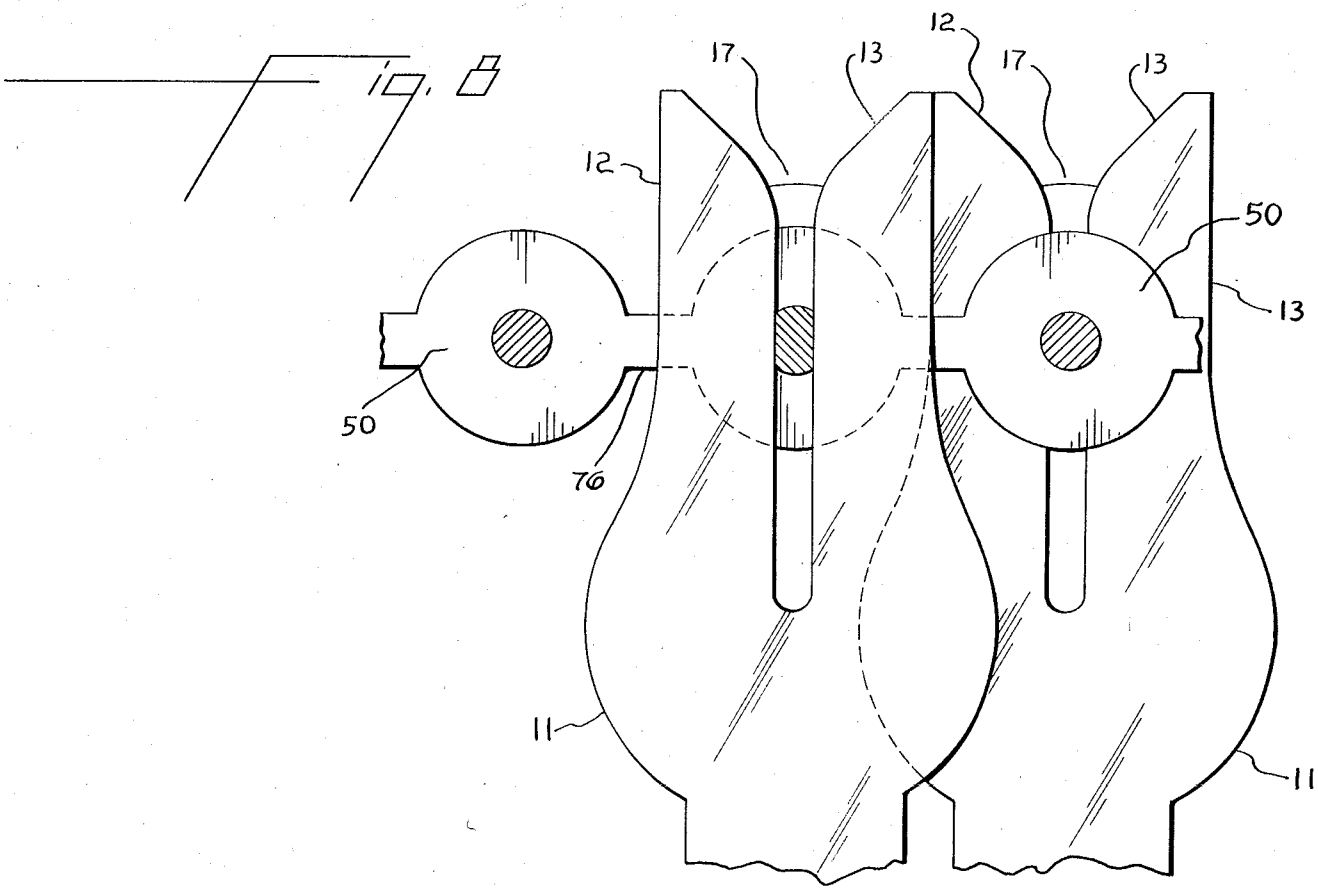
FIG. 8 shows in detail a first contact end of the terminal of FIG. 1 or FIG. 2.
Figure 5:
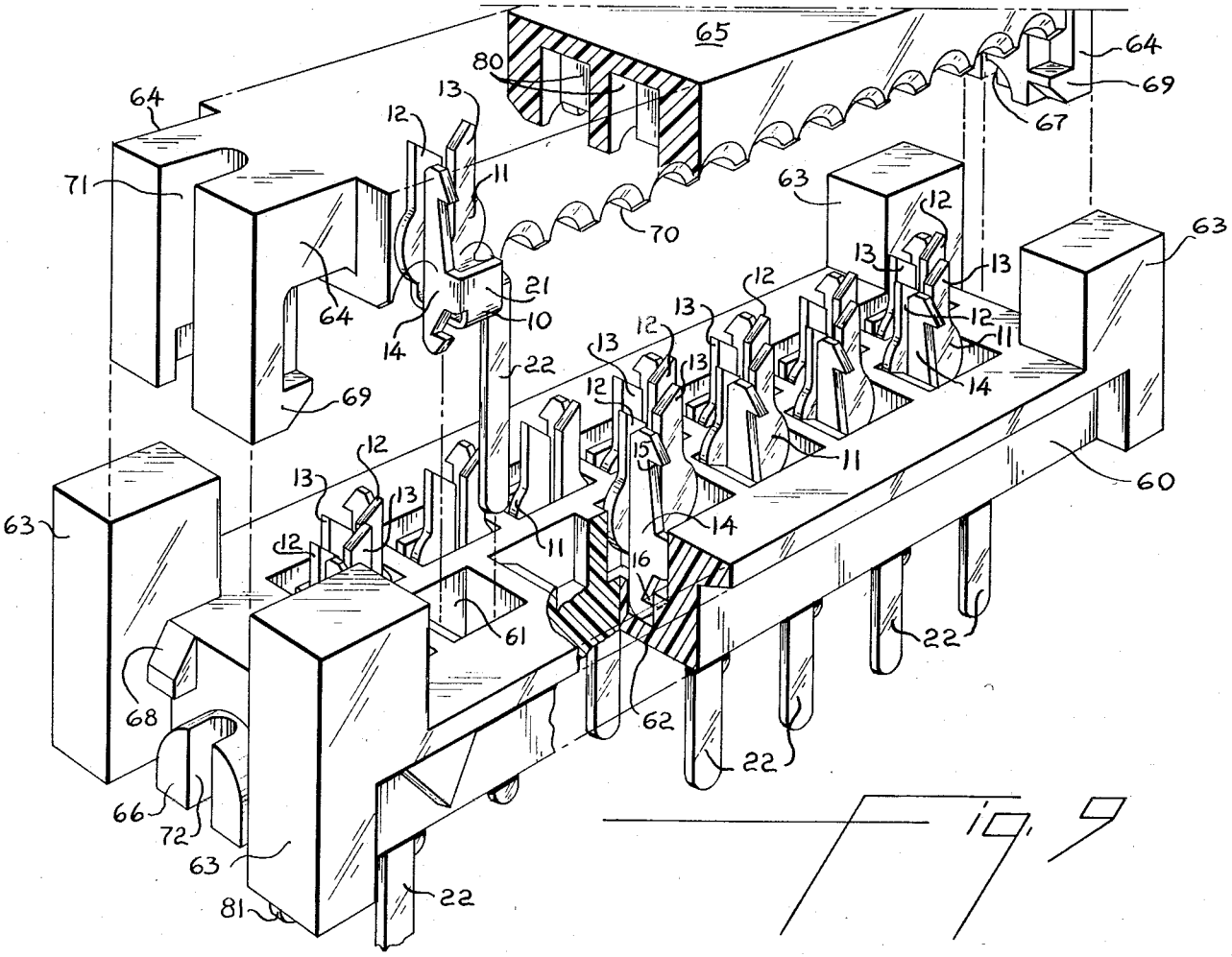

FIG. 8 shows the side view of two terminals respectively located in the two rows 51 and 52 of FIG. 7A, connected with the flat cable 50.

As shown in FIG. 9, a set of terminals is assembled in a lower housing part or terminal block 60 of plastics material. For the purpose of illustration, one terminal is shown prior to insertion in an appropriate channel 61 in the terminal block 60. Part of the terminal block 60 is cut away to illustrate a lower barb of the latching portion 14 of one terminal engaging the material of the terminal block 60, the lower barb engaging a blind hole 62 extending from the channel in which the terminal is engaged. With the terminals fully inserted in associated channels 61, the lower barbs of the latching portions 14 plough into the material defining the associated blind holes 62 to give desired terminal locking in the terminal block 60. At the same time, the latching portion support 21 rests against the corresponding wall of the channel 61.

The terminal block 60 has four corner posts 63, each of which engage corresponding flats 64 in upper housing part or pierce block 65. The terminal block 60 has a location stud 66 of part cylindrical profile at each of its extreme ends, the studs 66 engaging respective recesses 67 in the pierce block 65 in its lowest position. Furthermore, the terminal block 60 has four cams 68, two at each end which engage corresponding latches 69 integral with the pierce block 65. The pierce block 65 is preferably of plastic material and the latches 69 and cams 68 engage with a snap action.

The pierce block has a lower surface formed with part cylindrical grooves 70 to correspond to the outer profile of a flat cable to be inserted, to assist in retaining the flat cable in the assembled connector. The relationship between the grooves 70 and the flat cable 50 can be seen clearly in FIG. 10. The pierce block 65 is formed with two channels 71 at its extreme ends, the channels 71 being aligned with channels 72 in the studs 66. A cable clamping arm 73 is provided having arms 74 and 75 connected to legs 77 and 78. These legs 77 and 78 can be accepted in channels 71 and 72. In a finally assembled connector, the flat cable 50 is fed between the cable clamp 73 and the pierce block 65 to reduce the chance of any external forces experienced by the flat cable 50 being transmitted to the terminals. In FIG. 9, the channel 72 is shown extending completely through the studs 66, whereas in FIG. 10 the channel 72 is shown stopping short of the base of the studs 66. In the FIG. 9 arrangement, the arms 74 and 75 of the cable clamp 73, clamp around the bottom of the terminal block 60, whereas in the FIG. 10 arrangement, holes (not shown) are provided in the studs 66, which holes then accept the arms 74 and 75.

Figure 10:
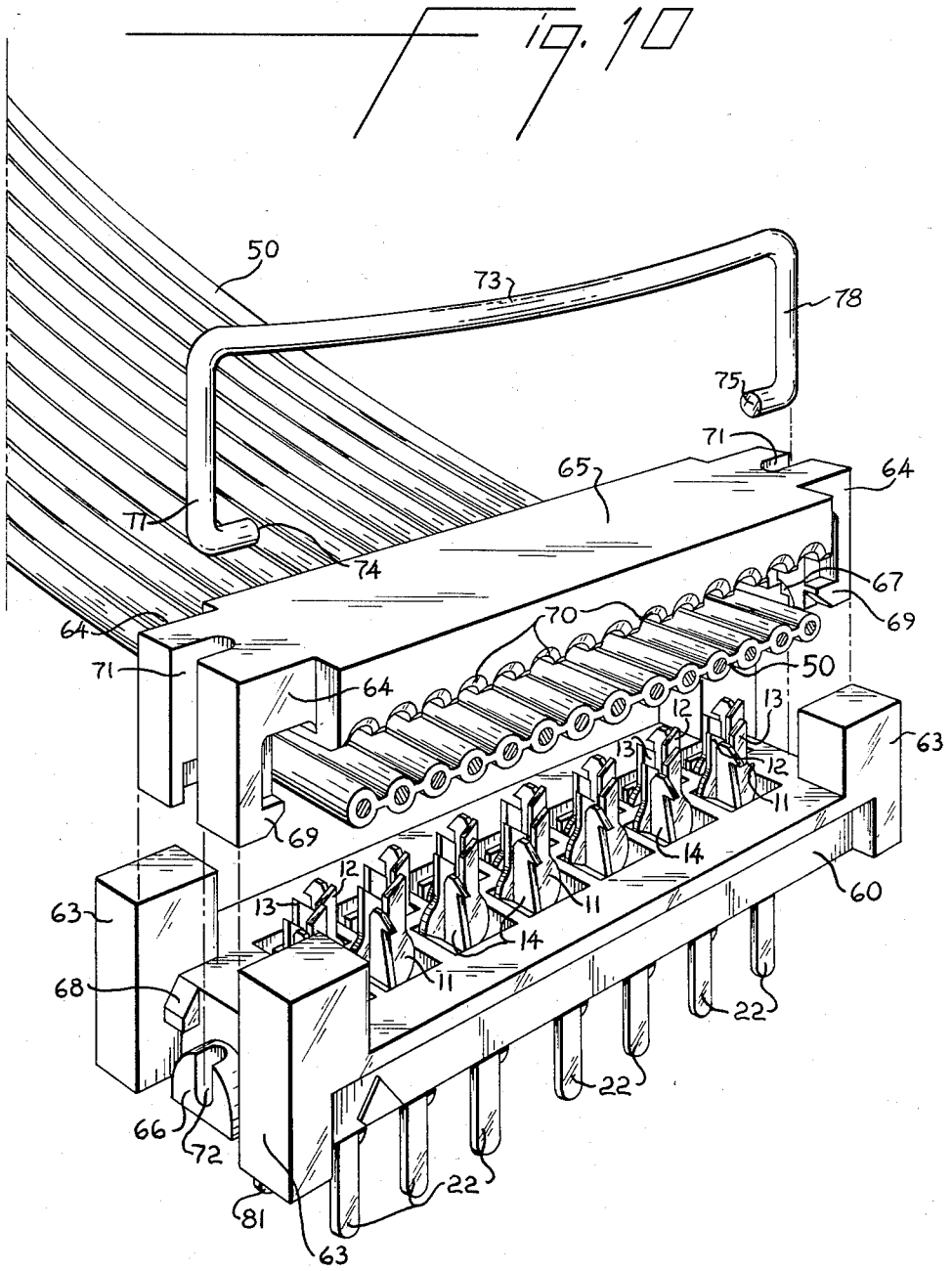
FIG. 10 shows a flat cable about to be pressed onto a set of terminals in a connector assembly.
Figure 11:
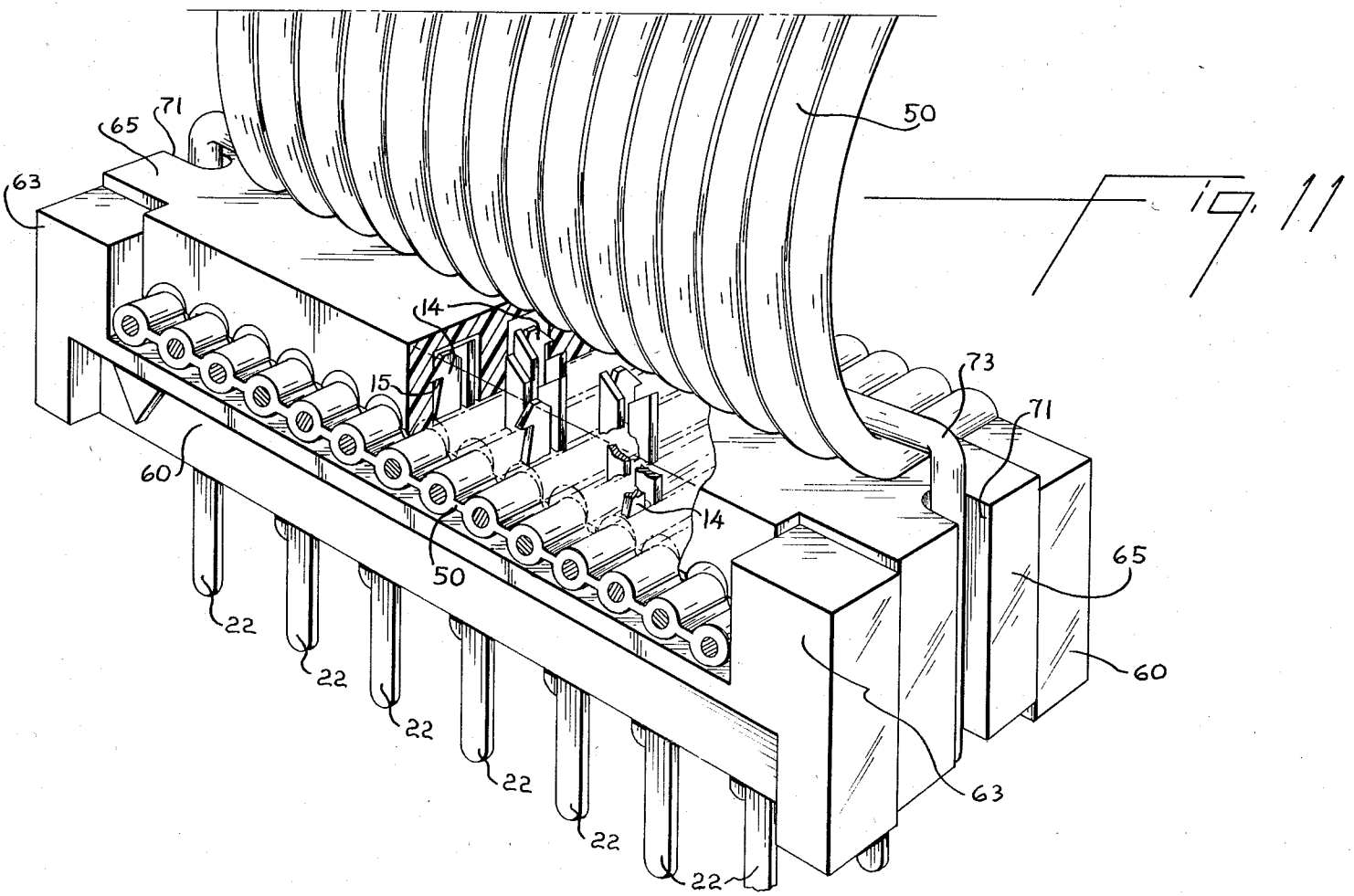
FIG. 11 shows a flat cable connected to a connector assembly.

From the position shown in FIG. 10, when the pierce block and terminal block are brought together, latches 68 and 69 engage at four corners of the assembly, while with pierce block 65 at its lowest position the studs 66 engage the recesses 67. During this process, the terminal latching portion 14 of each terminal penetrates a particular web 76 (FIG. 8) of the flat cable 50 and then ploughs into a recess 80 (FIG. 9) in the pierce block 65. The recesses 80 in the preferred embodiment are blind holes, although these could be modified in accordance with FIG. 6. The final assembly step is to bend the flat cable around the pierce block and fit the cable clamp 73.

The advantage of the FIG. 10 embodiment where the arms 74 and 75 of the cable clamp 73 engage holes in the studs 66 is that the cable clamp 73, which is of metal, does not subsequently contact any circuitry of a printed circuit board which may be located below the terminal block 60. The printed circuit board is not shown in FIG. 10. Additionally, the terminal block 60 is provided with plastic protuberances 81 to prevent such electrical contact between metal cable clamp 73 with adjacent circuitry in a printed circuit board.

It is necessary for the connector assembly to adapt to various flat cable sizes, commonly caused by different conductor wire size associated with respective insulation thicknesses in flat cables. In each case, it is necessary that the terminal block and pierce block be locked together. In the foregoing description, locking of the two blocks has been achieved by the terminal latching portions at individual terminal locations, and by engagement of the latches 69 of the pierce block with the cams 68 of the terminal block.

Figure 12B:
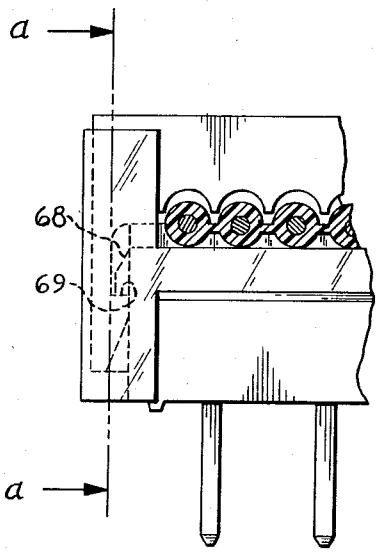
FIGS. 12A and 12B are views showing how the connector assembly adapts to cables of different diameter, FIG. 12A being a sectional view along the line A—A in FIG. 12B.
Figure 12A:
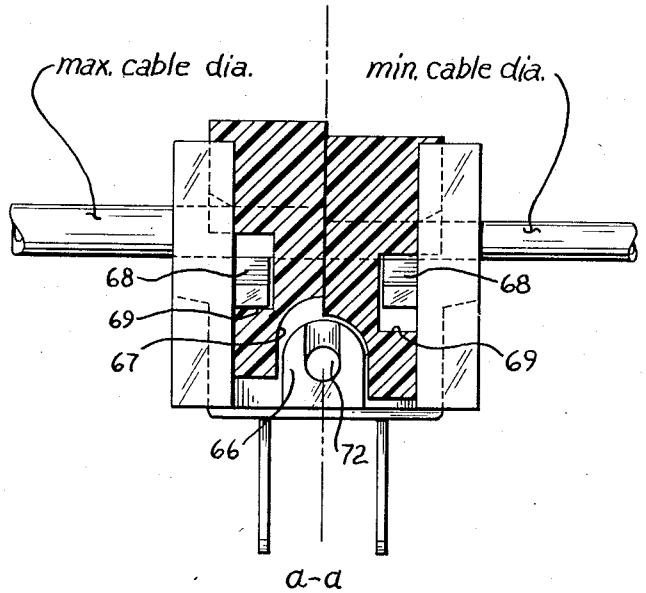

FIG. 12 shows how different cable diameters can effect the final configuration of the connector assembly. The configuration of the latches 69 and cams 68 is such that they engage one with the other when a maximum cable diameter is used (left part of FIG. 12A) in the final connector assembled condition.

However, with a minimum cable size, the latches 69 extend beyond the cams 68, there being therefore no engagement between the two. Engagement of the studs 66 with recesses 67 defines the end position of a conductor in an associated terminal slot 17 for minimum sized cables. For both maximum and minimum sized cables, the individual latching portions of each terminal ensure locking at all terminal stations of the connector assembly.

The advantage of the aforesaid embodiments of terminal is that, in a connector assembly, they provide locking together of the pierce block and terminal block at each terminal. This ensures that localized separation of the connector blocks is prevented, which separation could effect long-term contact reliability between the terminal and an associated conductor. The locking achieved by each terminal is, however, independent of the contact portion so that any possible movement of the latching portion associated with external forces on the cable does not induce any side effects or contact movement for the established connection between the cable and connector terminal tines.

I claim:

1. An electrical connector assembly for terminating a flat cable having multiple insulated conductors separated by a web, the assembly comprising a plastic block member and a plastic upper housing member, the block member having a multiplicity of channels each retaining an electrical terminal having an insulation displacement contact at a first end and another electrical contact at a second end with a body portion separating the first and second ends, a shoulder and support member together forming an L-shaped member extending perpendicularly from the body portion and supporting a pair of latches spaced apart from the first end, one latch engaging with a wall in the channel within the block member and the other with a wall in a recess in the upper housing member after piercing the web between a pair of the conductors of the flat cable.

2. An electrical connector according to claim 1 wherein one latch is engaged with an inner wall surface of the block member channel and a like inner wall surface in a recess within the upper housing member is engaged by the other latch.

3. An electrical connector according to claim 1 wherein the latch engaged with the block member has a latch surface mating with a step in the channel and the latch engaged with the upper housing member has a latch surface mating with a step in the recess.

4. An electrical connector according to claim 1 wherein cable clamping means external of the block and upper housing members clamps the cable to the connector assembly.

5. An electrical connector according to claim 1 wherein the block member and upper housing member have mutually engageable holding means.

6. An electrical connector according to claim 5 wherein the holding means comprise snap engagement latches.

* * * * *